US006978551B2

(12) United States Patent
Krake et al.

(10) Patent No.: US 6,978,551 B2
(45) Date of Patent: Dec. 27, 2005

(54) PICTURE HANGING DEVICE

(76) Inventors: Kelly R. Krake, 60 Wildwood Dr. SW., Calgary, Alberta (CA) T3C 3C5; Liette Tousignant, 60 Wildwood Dr. SW., Calgary, Alberta (CA) T3C 3C5

( * ) Notice: Subject to any disclaimer, the term of this patent is extended or adjusted under 35 U.S.C. 154(b) by 0 days.

(21) Appl. No.: 09/742,101

(22) Filed: Dec. 22, 2000

(65) Prior Publication Data

US 2002/0078582 A1 Jun. 27, 2002

(51) Int. Cl.[7] ..... G01D 21/00; B25H 7/00
(52) U.S. Cl. ..... 33/613; 33/666; 33/669
(58) Field of Search ..... 33/613, 644, 645, 33/666, 669, 677, 679

(56) References Cited

U.S. PATENT DOCUMENTS

| | | | | | |
|---|---|---|---|---|---|
| 2,048,335 | A | * | 7/1936 | Hardy | 33/666 |
| 2,338,592 | A | * | 1/1944 | Lorenzen | 33/666 |
| 3,516,165 | A | | 6/1970 | Pfeffer | |
| 3,665,610 | A | * | 5/1972 | Schlau et al. | 33/679 |
| 4,155,169 | A | * | 5/1979 | Drake et al. | 33/169 C |
| 4,220,309 | A | * | 9/1980 | Eisen et al. | 248/542 |
| 4,220,330 | A | | 9/1980 | Montgomery | |
| 4,382,337 | A | * | 5/1983 | Bendick | 33/180 R |
| 4,454,782 | A | | 6/1984 | Kemper | |
| 4,455,758 | A | | 6/1984 | Iwafune | 32/282 |
| 4,473,957 | A | | 10/1984 | Faulkner | 33/180 |
| 4,512,084 | A | * | 4/1985 | Lieberman | 33/180 R |
| 4,559,690 | A | | 12/1985 | Asmus | 29/270 |
| 4,648,185 | A | * | 3/1987 | Brandimarte | 33/189 |
| 4,893,776 | A | | 1/1990 | Floyd | 248/475.1 |
| 4,976,037 | A | * | 12/1990 | Hines | 33/27.03 |
| 5,103,572 | A | | 4/1992 | Ricklefs | 33/558 |
| 5,103,574 | A | * | 4/1992 | Levy | 33/760 |
| 5,109,611 | A | | 5/1992 | Houck | 33/613 |
| 5,180,135 | A | | 1/1993 | Hindall | 248/544 |
| 5,202,449 | A | | 4/1993 | Hasegawa | 552/266 |
| 5,465,500 | A | * | 11/1995 | Nammoto | 33/666 |
| 5,471,760 | A | | 12/1995 | Farris | 33/613 |
| 5,509,213 | A | | 4/1996 | Kelly | 33/613 |
| 5,867,917 | A | * | 2/1999 | Karon | 33/613 |
| 5,933,973 | A | * | 8/1999 | Fenley, Jr. | 33/644 |
| 6,000,142 | A | * | 12/1999 | Deaton | 33/613 |
| 6,029,382 | A | | 2/2000 | Kochanowski | 40/582 |
| 6,032,278 | A | | 2/2000 | Parvathala | 714/726 |
| 6,042,078 | A | | 3/2000 | Donovan | 248/547 |
| 6,049,991 | A | | 4/2000 | Gruenberg | 33/613 |
| 6,178,655 | B1 | * | 1/2001 | Potter et al. | 33/668 |
| 6,185,831 | B1 | * | 2/2001 | Pluciennik | 33/613 |
| 6,286,803 | B1 | * | 9/2001 | Prllino et al. | 248/490 |
| 6,421,928 | B1 | * | 7/2002 | Miller | 33/520 |
| 6,739,065 | B2 | * | 5/2004 | Hofmeister et al. | 33/613 |
| 6,883,244 | B2 | * | 4/2005 | Rimback | 33/613 |
| 2002/0170189 | A1 | * | 11/2002 | Cheatham | 33/194 |
| 2002/0189119 | A1 | * | 12/2002 | High | 33/613 |

FOREIGN PATENT DOCUMENTS

| | | |
|---|---|---|
| GB | 2262443 | 6/1993 |
| WO | WO 88/02230 | 4/1988 |
| WO | WO91/18541 | 12/1991 |

* cited by examiner

*Primary Examiner*—Gail Verbitsky

(57) ABSTRACT

A picture hanging device has a body, at least one marking element extending from one side of the body for marking a wall and the like, the body having at least one flexible portion which is of one piece with a remaining portion of the body, the marking element being arranged on the at least one flexible portion so that by displacing the at least flexible portion relative to the remaining portion of the body, the marking element can be displaced transversely to the body for marking purposes.

5 Claims, 2 Drawing Sheets

PICTURE HANGING DEVICE

BACKGROUND OF THE INVENTION

The present invention relates to devices for hanging pictures and similar objects.

Frame hanging devices are generally known in the art. It is important to mark a wall before hanging a picture, and therefore some frame hanging devices include means for marking a wall as to where to place a nail, screw or other frame hanging means. Some of these devices are disclosed for example in U.S. Pat. Nos. 3,516,165; 4,220,300; 4,454,782; 4,455,758; 4,473,957; 4,893,776; 5,202,449; 6,029,382; 6,032,278; 6,049,991; 6,042,078; 4,559,690; 5,471,760; 5,109,611; 5,103,572; 5,180,135; 5,509,213, as well as in EP 812661, DE 2,262,443; 2,970,568 and 4,128,472, GB 2,262,443 and WO 88/02230 and 91/18541. The existing devices can be further improved.

SUMMARY OF THE INVENTION

Accordingly, it is an object of present invention to provide a picture hanging device which is a further improvement of the existing devices.

In keeping with these objects and with others which will become apparent hereinafter, one feature of present invention resides, briefly stated, in a picture hanging device which has a body, at least one button extending from one side of said body, at least one marking device extending from another opposite side of said body substantially opposite to said at least button so that by pressing said button said marking device can be extended for marking a wall and the like, said body having at least one flexible portion which is of one piece with the remaining portion of said body, and said marking element is arranged on said one portion so that by displacing said at least one portion relative to said remaining portion of said body, said marking device can be displaced transversely to said body for marking purposes.

When the picture hanging device is designed in accordance with the present invention, it provides efficient marking, and at the same time it has a simple construction, it is easy to manufacture and to use.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
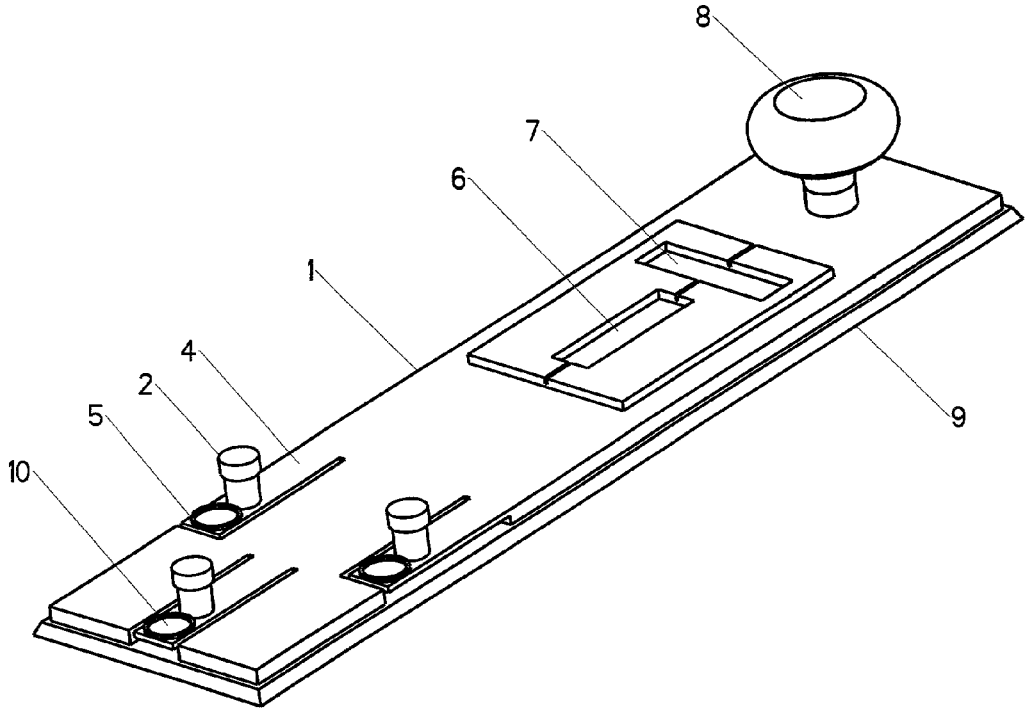
FIG. 1 is a perspective view of a picture hanging device in accordance with the present invention, from above.
Figure 2:
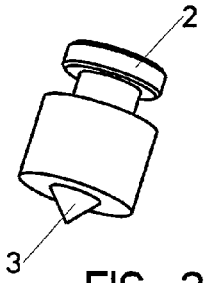
FIG. 2 is a view schematically showing a pin-shaped member of the inventive device which provides marking.

A picture hanging device in accordance with the present invention has a body which is identified as a whole with reference numeral 1. The body can have a rectangular configuration, a triangular configuration and the like. At least one, and preferably three buttons 2 are provided on one side or surface of the body 1 for hanging a picture. At least one marking element, and preferably three marking elements 3 are provided on the opposite side or surface of the base 1.

As can be seen from FIG. 1, at least one flexible portion or preferably three flexible portions 4 are formed in the body 1. In particular, they are formed by grooves 5 which separate the flexible portions 4 from a remaining portion of the body 1. The portions 4 can flex in direction perpendicular to the upper and lower surfaces of the body 1. The marking elements 3 are arranged on the opposite side of the flexible portions. The marking elements 3 can be formed as sharp tips.

Figure 3:
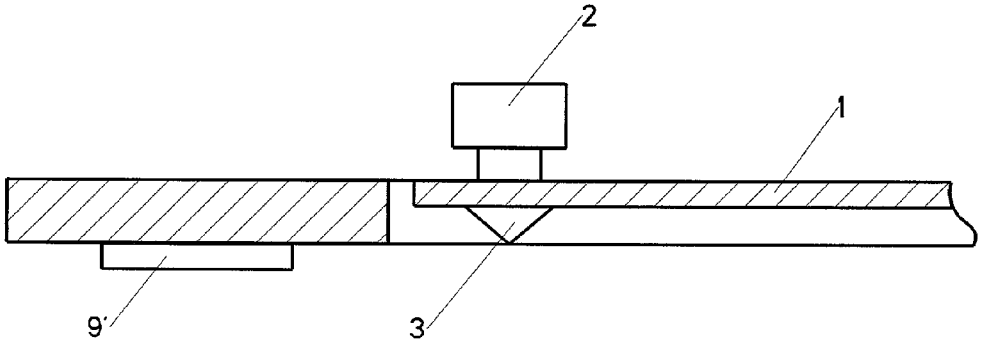
FIG. 3 is a view showing a cross-section of the inventive picture hanging device.
Figure 4:
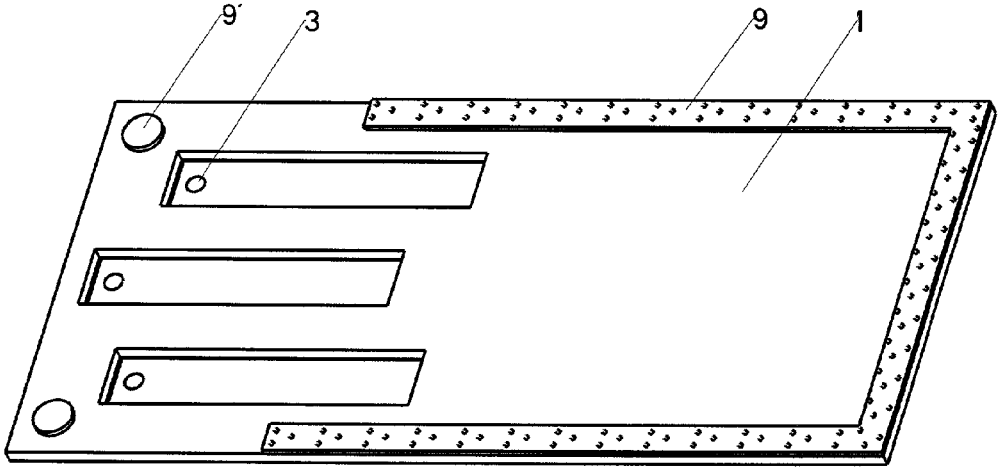
FIG. 4 is a perspective view of the picture hanging device from below.

As can be seen from FIG. 3, in an inoperative position, the marking elements 3 are located so that they do not extend beyond the lower surface of the body 1, since the body 1 has a projecting peripheral edge which forms a cavity for accommodation of the marking elements. When however it is necessary to mark a wall and the like an area 10 is pressed, the flexible portion 4 is pressed downwardly and the marking element 3 extends downwardly beyond the lower surface of the body 1 so as to mark a wall or the like. After the marking, the flexible portions 4, under the action of its springy property, springs back to a position shown in FIG. 3.

Leveling devices can be further provided as shown in FIG. 1. They can include two leveling devices 6 and 7 which can be formed as leveling bubbles and extend perpendicular to one another. Once after marking, the picture is hung on the nail or the like, the body 1 can be placed against the picture frame to level the picture horizontally and vertically.

The device further has a handle which is identified with reference numeral 8. The handle is located at an end which is opposite to the end provided with the marking elements 3. Finally, the device can be provided with a continuous silicone layer 9 extending over a perimeter of a lower surface of the body 1, or discrete silicone pads 9' attached in certain points to the lower surface of the device. In the inoperative position the marking elements 3 do not extend beyond the layer 9 or the pads 9'. However, when the area 10 is pressed the marking elements 3 are extended beyond the layer 9 or the pad 9' for marking purposes.

It is to be understood that the layer 9 or the pads 9' can be composed of another material which prevents scratching of corresponding surfaces and provide friction to prevent inadvertent movement of the device.

The device operates in the following manner.

When it is necessary to accurately determine the exact position of a picture, or a similar wall mounted object to be placed on any wall or hanging surface, a picture is hung on any of the extending buttons 2. A person holding onto the handle 8 then positions the device, together with the picture, against the hanging surface at exactly the location that the picture is intended to be hung. When the exact location is chosen, the picture is removed and one or more areas 10 are depressed. This action causes the marking element 3 to mark the hanging surface, marking the exact location in which a picture hanging member, such as a nail, should be inserted. Once this has occurred, the picture or object can then be hung in its exact position and leveled using the leveling elements 6 or 7.

The device in accordance with the present invention can be made of one piece, with all elements made integrally on it. It can be composed for example of plastic. It does not require any assembly, it is inexpensive to produce and easy to use. It is light, provides an accurate marking and is useful as a straight edge, a level or a ruler. It incorporates a space in which information or advertising may be mounted or displayed.

It will be understood that each of the elements described above, or two or more together, may also find a useful application in other types of constructions differing from the types described above.

While the invention has been illustrated and described as embodied in picture hanging device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A picture hanging device, comprising a body; at least one marking element extending from one side of said body for marking a wall, said body having at least one flexible portion which is of one piece with a remaining portion of said body, said at least one marking element being arranged on said at least one flexible portion so that by displacing said at least one flexible portion relative to said remaining portion of said body, said at least one marking element can be displaced perpendicular to said body for marking purposes, wherein said body has a protruding peripheral edge which forms a recess accommodating said at least one marking element, so that in an inoperative position said at least one marking element does not extend beyond a surface of said body, while in an operative position in which said at least one flexible portion is displaced, said at least one marking element extends beyond said surface of said base.

2. A picture hanging device, comprising a body; at least one marking element extending from one side of said body for marking a wall, said body having at least one flexible portion which is of one piece with a remaining portion of said body, said at least one marking element being arranged on said at least one flexible portion so that by displacing said at least one flexible portion relative to said remaining portion of said body, said at least one marking element can be displaced perpendicular to said body for marking purposes, and further comprising a protective element provided on a bottom surface of said body, said at least one marking element in an inoperative position not extending beyond said protective element, while in an operative position in which said at least one portion is displaced, said at least one marking element extends beyond said protective element.

3. A picture hanging device as defined in claim 2, wherein said protective element is formed as a continuous protective layer.

4. A picture hanging device as defined in claim 2, wherein said protective element includes a plurality of protective pads.

5. A picture hanging device as defined in claim 2, wherein said protective element is composed of a material which provides friction.

* * * * *